US005188291A

United States Patent [19]

Cross

[11] Patent Number: 5,188,291

[45] Date of Patent: Feb. 23, 1993

[54] FLUID DISTRIBUTION DEVICE

[75] Inventor: David J. Cross, Mamaku, New Zealand

[73] Assignee: Her Majesty the Queen in right of New Zealand, New Zealand

[21] Appl. No.: 529,886

[22] Filed: May 29, 1990

[51] Int. Cl.[5] ..... B05B 5/04

[52] U.S. Cl. ..... 239/3; 239/8; 239/399; 239/704

[58] Field of Search ..... 239/229, 267.1, 706–708, 239/694.8, 399.3, 423, 424.5

[56] References Cited

U.S. PATENT DOCUMENTS

| | | | |
|---|---|---|---|
| 1,581,759 | 4/1926 | Morse | 239/405 X |
| 2,361,144 | 10/1944 | Loepsinger | 239/424 X |
| 2,620,232 | 12/1952 | King | 239/229 |
| 2,758,874 | 8/1956 | Snyder | 239/229 |
| 3,000,575 | 9/1961 | Hruby | 239/405 X |
| 3,108,749 | 10/1963 | Drayer et al. | 239/229 X |
| 3,985,297 | 10/1976 | Itoh | 239/706 X |
| 4,795,094 | 1/1989 | Correard | 239/229 |

*Primary Examiner*—Andres Kashnikow
*Assistant Examiner*—Kevin P. Weldon
*Attorney, Agent, or Firm*—Knobbe, Martens, Olson & Bear

[57] ABSTRACT

The invention relates to a fluid distribution device in the form of a sprayer. A preferred embodiment of the sprayer uses a rotating fluid conduit which makes use of centrifugal force to break up fluid emerging from the conduit into fine droplets. Air flow though the preferred embodiment may shear the fluid droplets and assist in carrying them to the desired target. An apparatus for placing an electrostatic charge on the droplets may also be used.

12 Claims, 9 Drawing Sheets

FLUID DISTRIBUTION DEVICE

BACKGROUND OF THE INVENTION

This invention relates to fluid distribution devices.

The present invention is concerned more particularly with fluid distribution devices that are spraying apparatus, that is apparatus that breaks down liquid or a liquid/gas combination into small droplets. Spraying apparatus may also spray powders. Spraying apparatus come in a variety of forms and have been used in a variety of applications including painting, horticultural spraying and timber treatment. Spraying apparatus can however, be generally identified as falling into one of the following five classes, that is either hydraulic, pneumatic, electro-mechanical, centrifugal or thermal.

Unfortunately, there are a number of disadvantages associated with conventional spraying apparatus. It can be difficult to control the spray emerging from the spraying apparatus in terms of rate of fluid discharge, size of droplets and targeting. Although it is desirable in most situations to produce an even cloud of fine droplets, that is very difficult to achieve. Furthermore, the liquid outlets in most of the sprayers in the five classes are relatively small orifices or jets. The presence of such constrictions leads to problems with blocking unless the spray liquid is kept clear of troublesome particles. In the past on-line filtering has been used to overcome this problem but this involves extra equipment and an undesirable reduction in flow rate.

It is desirable that an electrostatic charge can be transferred to droplets emerging from a spraying apparatus as charged droplet are attracted to a spraying target which has surfaces of lower electrical potential. This attraction serves to partially overcome other forces influencing the droplet trajectories, such as frictional drag by airstream boundary effects. Therefore it can be seen that electrostatic charging adds depositional efficiency. Uniform charging of a droplet cloud has been difficult to achieve with waterbased or other conductive media, though standard in the painting industry where resistive fluids are used. With conductive fluids, either the whole apparatus, including supply tanks must be heavily insulated from earth (to withstand many kilovolts) or the high charge must in some way be earthed through the droplet cloud into the fluid column.

It is an object of the present invention to address the above problems.

SUMMARY OF THE INVENTION

Further objects and advantages of the present invention will become apparent from the following description which is given by way of example.

According to one aspect of the present invention there is provided a nozzle assembly for a fluid distribution device including a fluid conduit with a first end and a second end, the fluid conduit having a flexible element enabling the first end of the fluid conduit to move with respect to the second end of the fluid conduit, the second end being connectable to a fluid supply, the nozzle assembly characterized in that the first end of the fluid conduit can move with respect to the second end of the fluid conduit sufficiently than the centrifugal force created by the movement of the first end is sufficient to break up the fluid from the fluid conduit as it emerges from the first end.

BRIEF DESCRIPTION OF THE INVENTION

According to another aspect of the present invention there may be provided a nozzle assembly as described above wherein there is sufficient space around the first end of the fluid conduit to allow gas flow introduced into the nozzle assembly to emerge coincident with the fluid droplets emerging from the first end of the conduit.

According to a further aspect of the present invention there may be provided a nozzle assembly as described above wherein gas flowing past the first end of the fluid conduit is sufficient to cause a shearing effect on the fluid droplets emerging from the first end of the conduit.

In the present invention the movement of the fluid conduit supplies a centrifugal force which causes the fluid within the said conduit to be broken up before being flung outwards. While there have been centrifugal fluid distribution devices before, a difficulty with conventional centrifugal devices is that the droplets are generally flung out to the side and no coherent spray is produced. This is not suitable for many spray applications. Furthermore it is difficult to place electrostatic charges on droplets emerging from conventional centrifugal devices except by generally cumbersome means.

The first end of outlet of the fluid conduit may be of a greater diameter than outlets on conventional sprayers as the size of the outlet is not the major factor determining droplet size. The greater diameter means that there is less chance of blocking and little need for on-line filters. The nature of the centrifugal forces causes the fluid to emerge from the outer circumference of the conduit outlet, that is, the fluid emerges from the part of the conduit outlet furtherest from the axis of movement.

There are of course, a number of embodiments into which the present invention can be incorporated. In a preferred embodiment the fluid conduit may be a rigid tube, with a flexible joint as the flexible element. The flexible joint assists in allowing movement of the first end of the tube to occur with respect to a second fixed end. Another embodiment may have the whole of the conduit being the flexible element. Other forms of fluid conduits are also envisaged.

In one embodiment of the present invention the fluid conduit may be contained within a housing and may be aligned substantially with the housing outlet along the central axis of the nozzle assembly housing. At the end of the conduit furthest away from the housing outlet may be short flexible section which permits movement of the end of the conduit nearest the housing outlet. One end of the fluid conduit may be connected to a liquid supply that may or may not have have pumping means to push fluid through the conduit. Surrounding the fluid conduit may be walls which ensure that the radius of rotation of the tube is limited.

An alternative embodiment of the present invention is the provision of a device which can apply an electrostatic charge to fluid emerging from a nozzle assembly. This is more readily possible with the present invention as it is easier to surround a moving conduit with an electrostatic charging means than it is to surround other conventional nozzle assemblies.

In one embodiment the device may be in the form of a thin metal electrode ring situated near the nozzle assembly housing outlet. Preferably the electrode ring is situated with the housing of the nozzle assembly so as to reduce the chances of imparting an electrical shock to the operator of the spraying device. For this device to work, it is preferably that the nozzle assembly be made of electrically resistant components to eliminate the risk of shorting.

The ring may be connected to a power source by a supply wire. It is envisaged that the voltage required to successfully impart a charge to the spray fluid will be in the order of kilovolts so it is important that the supply wire is of a highly insulated type suited for carrying such a voltage. In one embodiment the liquid within the liquid supply may be connected to electrical earth outside the body of the nozzle.

In operation liquid droplets flowing from the fluid conduit come into proximity with the electrode ring of the electrostatic device. Electrical contact is made between the liquid column in the fluid conduit and the ring by coronal discharge by reason of the higher electrical potential difference between the ring and the liquid which is held at earth potential. A charge is transferred to the droplets formed within this coronal discharge such that a spray cloud carried through the outlet of the housing has an electrostatic potential well above that of earth. The charged droplets are attracted to the target which has surfaces of lower potential. This attraction serves to partially overcome other forces influencing the droplet trajectories, such as frictional drag by air stream boundary effects, and thus adding depositional efficiency.

An even distribution of charge on the droplet cloud can be achieved as the present invention provides a droplet source in the form of the fluid conduit which moves fast enough to create a instability thus preventing a single arc from the electrostatic charging means forming.

In other embodiments the electrode need not be a ring but any element capable of carrying a high voltage which can be situated near the spray droplets.

A further aspect of the present invention is to have a sufficient air space around the first end of the fluid conduit and include a flow of gas in combination with the moving end of the fluid conduit. This enables the droplets to be carried on the gas stream to the intended target. The gas flow may also be sufficient to cause the droplets emerging from the conduit to be broken up as a result of a shearing action by the gas. This produces a much finer spray as well as a more coherent and directed spray.

By having both centrifugal and pneumatic means included within the nozzle assembly, greater control can be exerted upon the droplets. For instance, the rotational speed of the fluid conduit can be varied. The shearing effect on the droplets can also be controlled by varying the flow rate of the gas flowing through or around the nozzle assembly.

A number of advantages can be achieved by using gas flow introduced into the housing outlet to directly or indirectly move the fluid conduit. In the past, fluid supplies have been attached to mechanically driven air dispersal means such as fans. Unfortunately, these devices did not provide the mechanical simplicity inherent in the present invention. Furthermore the amount of air flow generated by the mechanical device to which the fluid supply was connected was not sufficient to provide the necessary pressure and volume of air required to shear fluid emerging from the liquid supply. For instance, with the present invention pressurized gas can be introduced into the housing to provide the required shearing effect. This is not possible with mechanical devices. Also, by not having a mechanically driven fluid conduit, the nozzle assembly can be of a more compact size and greater control of fluid and gas flow can be achieved.

The first end of the fluid conduit may be essentially free and that is not attached to any mechanical device and moved as a direct result of the gas flow introduced into the housing. In an alternative embodiment, the first end of the fluid conduit may be connected to an air dispersal device such as a fan wherein the air dispersal device is driven by the air flow introduced into the housing. Thus in the latter embodiment the air flow introduced indirectly causes the first end of the conduit to move.

In another embodiment the fluid conduit may be directly driven by a motor separate from the air dispersal means.

The nozzle assembly need not include a housing as in some embodiments the gas flow may be derived from air passing over the nozzle assembly as it is propelled through being attached to a tractor, an aircraft or some other vehicular device.

In a particular embodiment with a nozzle assembly housing, near the front of the housing by the housing outlet may be an air dispersal means in the form of a set of fins constructed so that pressurized air entering the assembly in a housing inlet passes through the fins before exiting via the housing outlet.

This in turn propagates a swirling motion in this air which imparts a movement to the first end of the fluid conduit, most likely a precession or rotation. The movement of the fluid conduit provides a centrifugal force which causes droplets to form as fluid emerges from the tube. This swirling action of the air passing through the housing outlet induces the droplets to shear resulting in the production of a fine controlled spray from the nozzle assembly and the air movement out of the housing outlet carries the mist to the spray target.

There may be provided two air dispersal means in the vicinity of the first end of the fluid conduit. If the second air dispersal means is constructed so that it disperses air in substantially the same direction as the first air dispersal means, then a broader stream of fluid droplets will be achieved than by the use of one air dispersal means only.

Conversely, the second air dispersal means may be constructed so that it disperses air in the opposite direction to the first air dispersal means. This will result in a narrower stream of fluid droplets being produced than if a single air dispersal means was used.

BRIEF DESCRIPTION OF THE DRAWINGS

Aspects of the present invention will now be discussed by way of example only with reference to the accompanying drawings in which.

DESCRIPTION OF PREFERRED EMBODIMENTS OF THIS INVENTION

Figure 1:
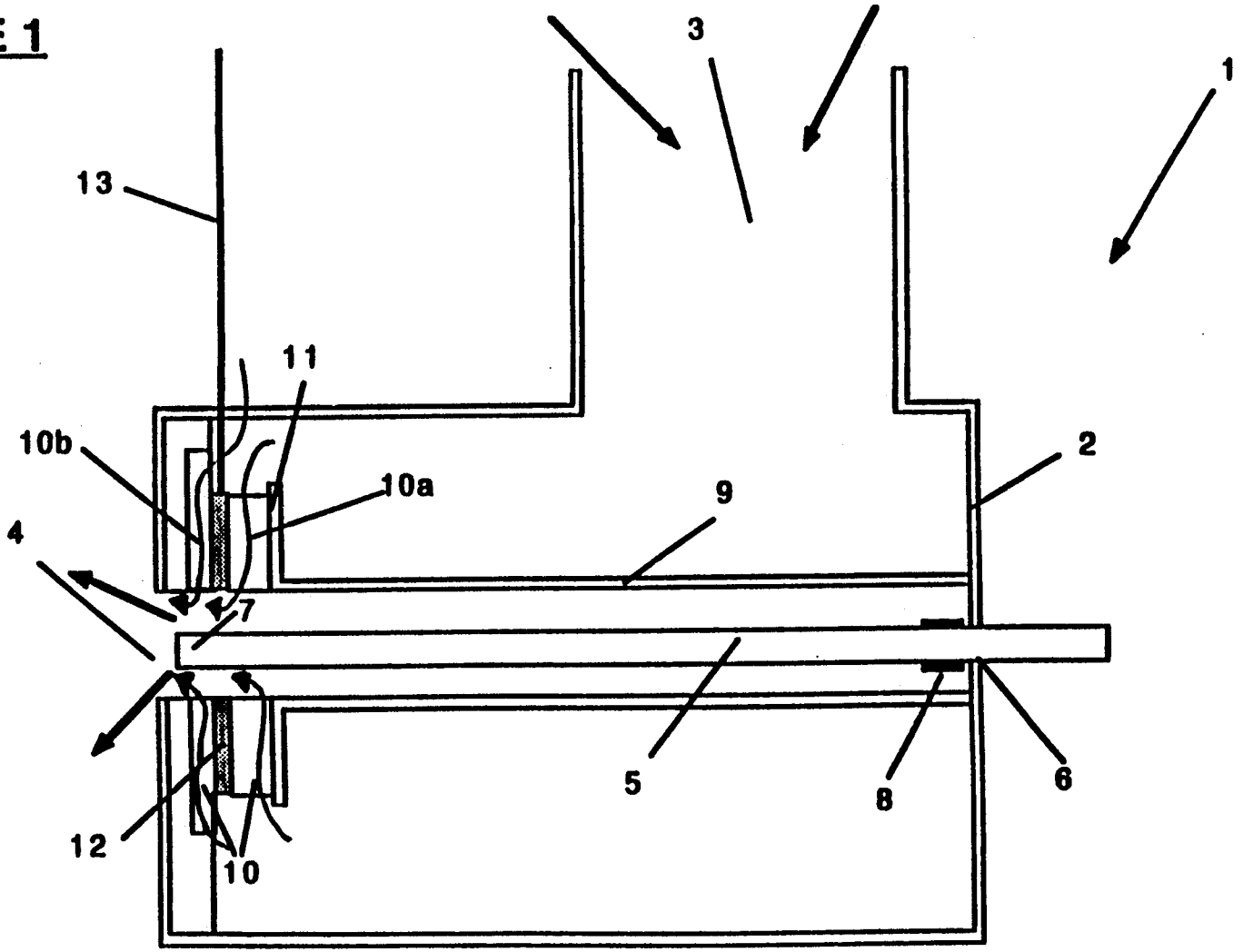
FIG. 1 is a diagrammatic cross-section of a nozzle assembly in accordance with one embodiment of the present invention.
Figure 2A:
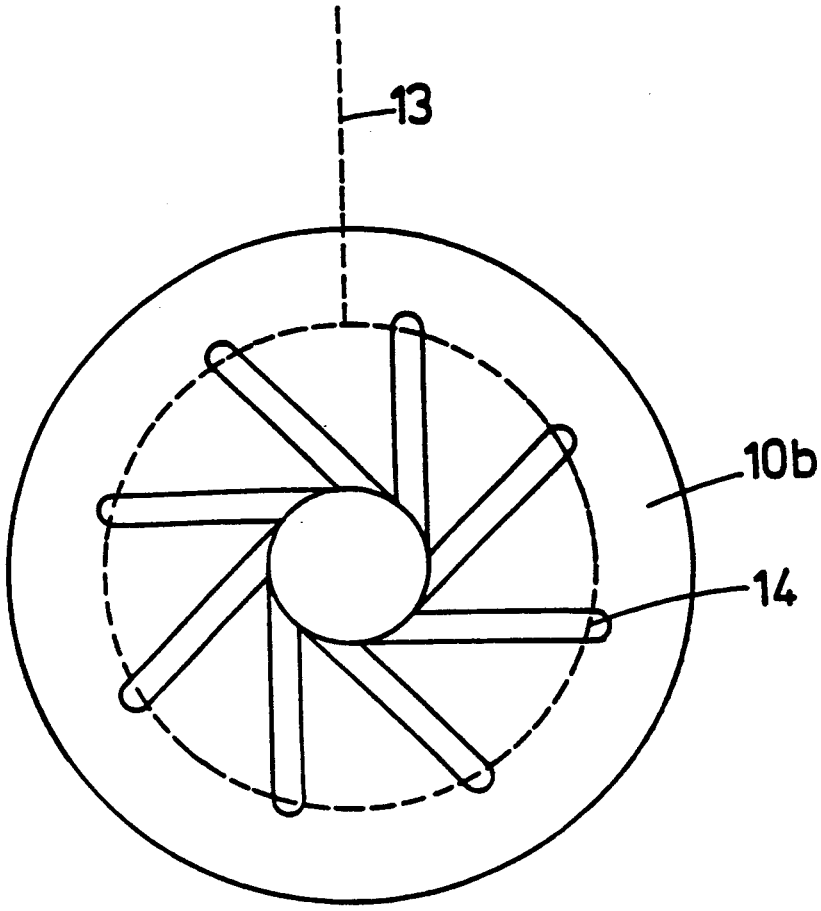
FIG. 2*a* is a diagrammatic cross-section of the top half of the air dispersal means.
Figure 2B:
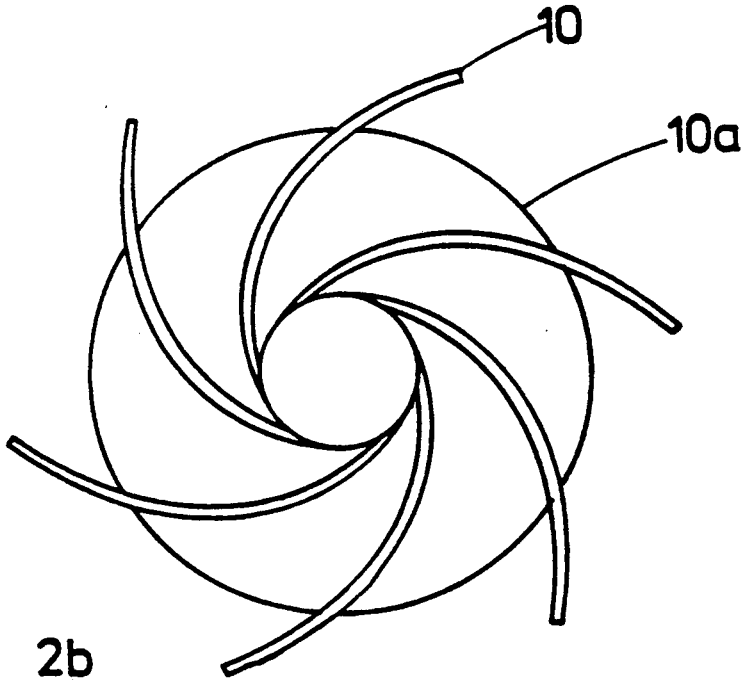
FIG. 2*b* is a diagrammatic cross-section of the bottom half of the air dispersal means.
Figure 3:
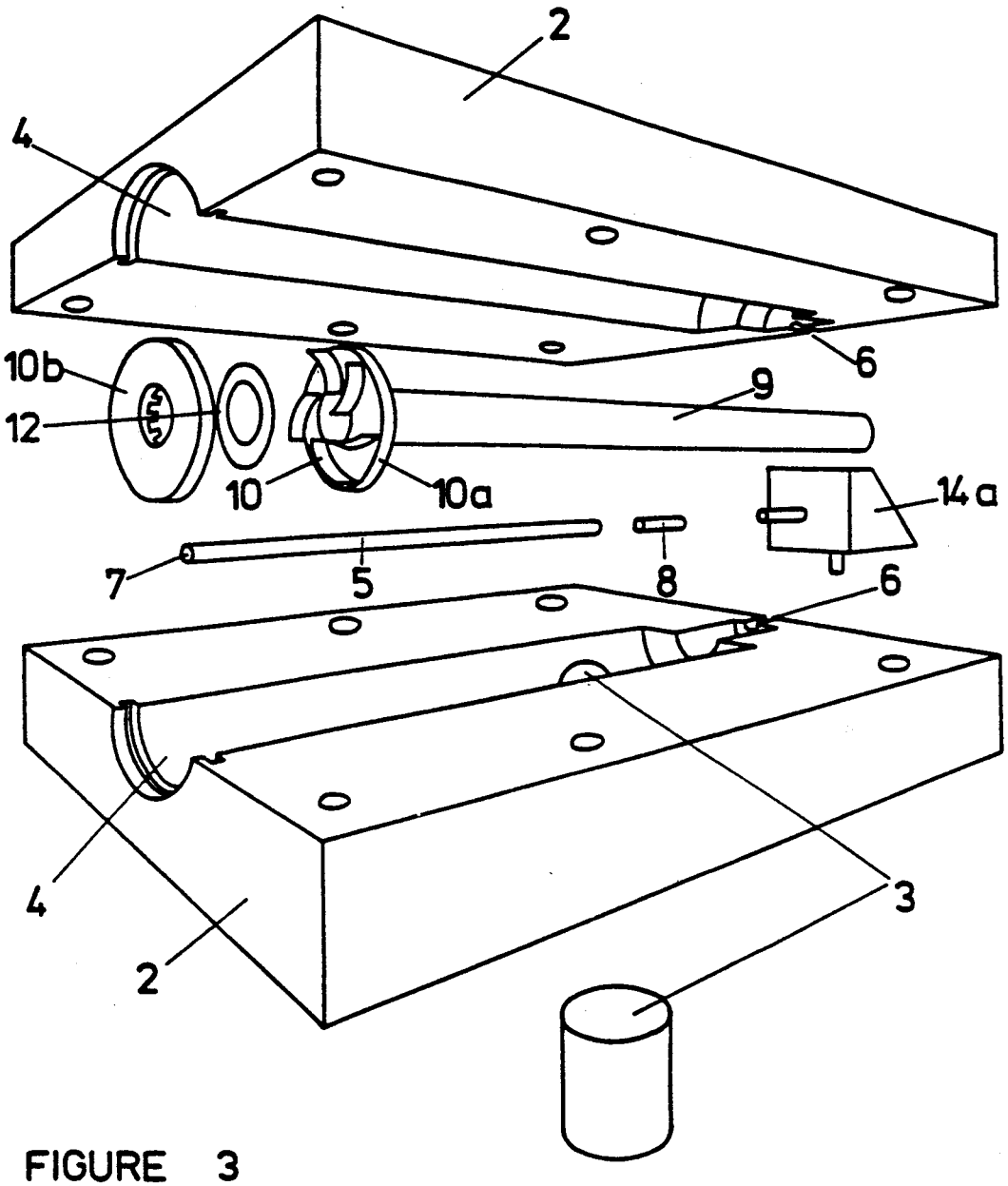
FIG. 3 is a diagrammatic perspective exploded view of the nozzle assembly in FIGS. 1 and 2.

With respect to FIGS. 1, 2 and 3 there is provided a nozzle assembly generally indicated by arrow 1 comprising a housing 2, a housing inlet 3, a housing outlet 4, and a fluid conduit 5 situated within the housing 2.

The fluid conduit 5 is situated so that part of the conduit 5 is fixed at point 6 relative to the housing 2. A liquid supply 14*a* (shown in FIG. 3) is attached to the fixed end of the conduit 5. The other free end 7 of the conduit 5 is situated near the housing outlet 4. The conduit 5 has a short flexible section 8 that is situated near point 6. Alongside the conduit 5 is a circular wall 9 which defines the maximum axis of rotation of the conduit 5.

Near the housing outlet 4 are two sets of air dispersal means 10*a* and 10*b*. The set adjacent to the housing outlet consists of an annular plate having cut into it a series of grooves 14. These grooves are tangential to the inner hole of the annulus as shown in detail in FIG. 2*a*, their outer ends being within the boundaries of the annulus's outer edge and are positioned in the housing such that the fin bearing surface faces towards the housing outlet and concentric with the grooved annular plate, the two being separated from each other by the electrode ring assembly in such a way as to form two sets of channels at right angles to the axis of the housing and contiguous with the housing outlet.

Other versions of the embodiment shown in FIG. 1 may only have finned air dispersal means adjacent to the housing outlet.

Within the housing 2 and between the two annular rings 10*a* and 10*b* is the aforementioned electrode-ring 12. A supply wire 13 is connected to the electrode ring and to a power supply (not shown). The liquid supply 14*a* is connected to electrical earth.

In operation, air under pressure enters the housing inlet 3 in the direction of the arrows shown. The major portion of this air passes through the fins 10 of the rearmost air dispersal means 10*a* inducing a swirling effect in the region adjacent to the end of the fluid conduit 5 causing the end of the conduit to rotate with respect to the longitudinal axis of the housing 2. The radius of rotation is determined by wall 9. The smaller portion of the air passes into grooves 14 of air dispersal means 10*b* emerging from their inward ends to produce a swirling motion of that air adjacent to the swirling air from between the fins of air dispersal means 10*a* but in the opposite sense. Liquid supplied to the conduit 5 by liquid supply 14*a* is flung out as a result of the centrifugal force created from its rotation. The air movement helps to shear the droplets with the opposing air swirls counteracting excessive width of the spray droplets swathe as they exit the housing outlet 4.

The electrode-ring 12 around the housing outlet 4 makes electrical contact through the fluid as a result of the high potential difference between the electrode-ring and the liquid. This causes a charge to be transferred to the droplets which aids in the targeting of the spray.

Figure 4:
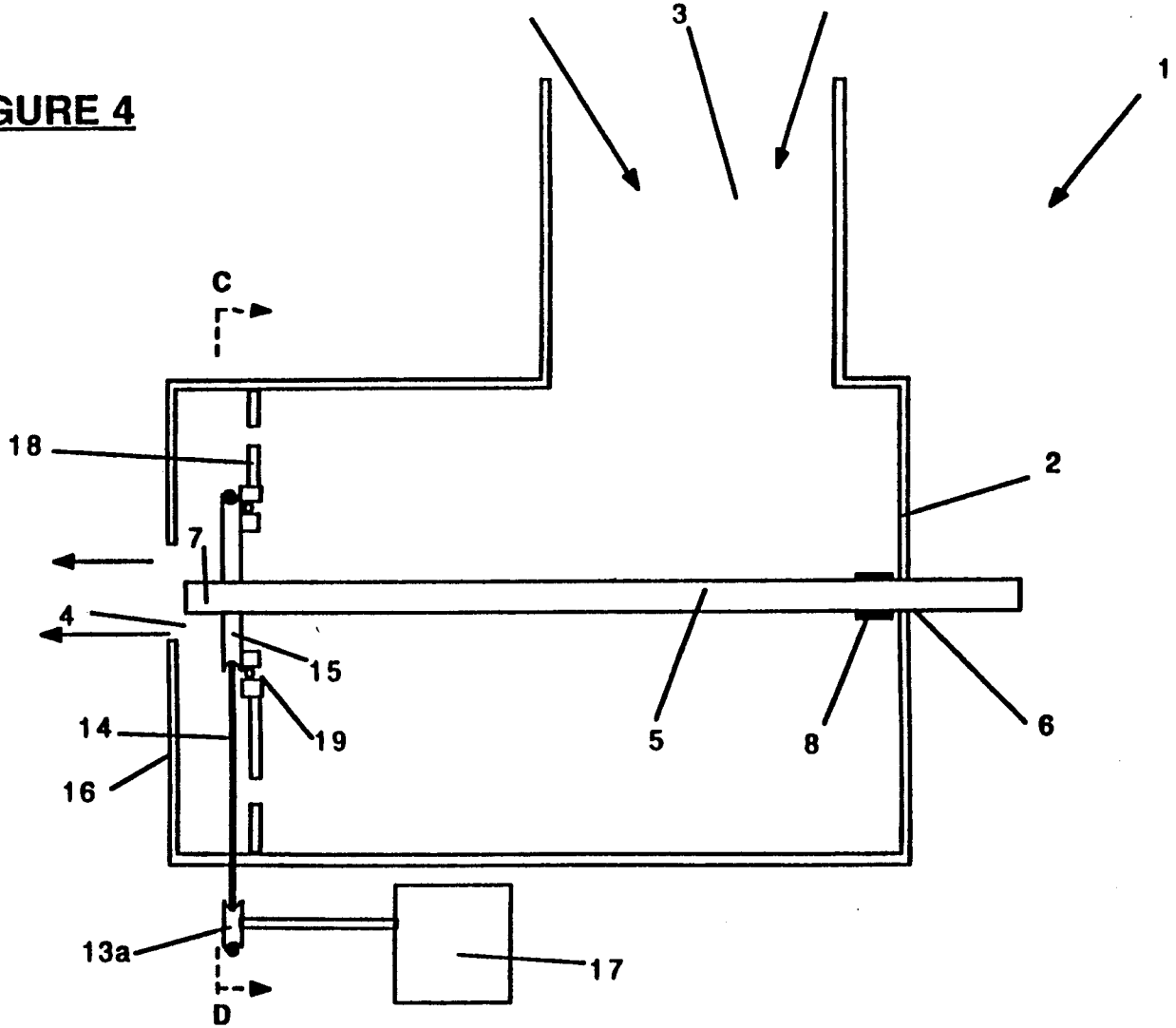
FIG. 4 is a diagrammatic cross-section of a second embodiment of the prevent invention.
Figure 5:
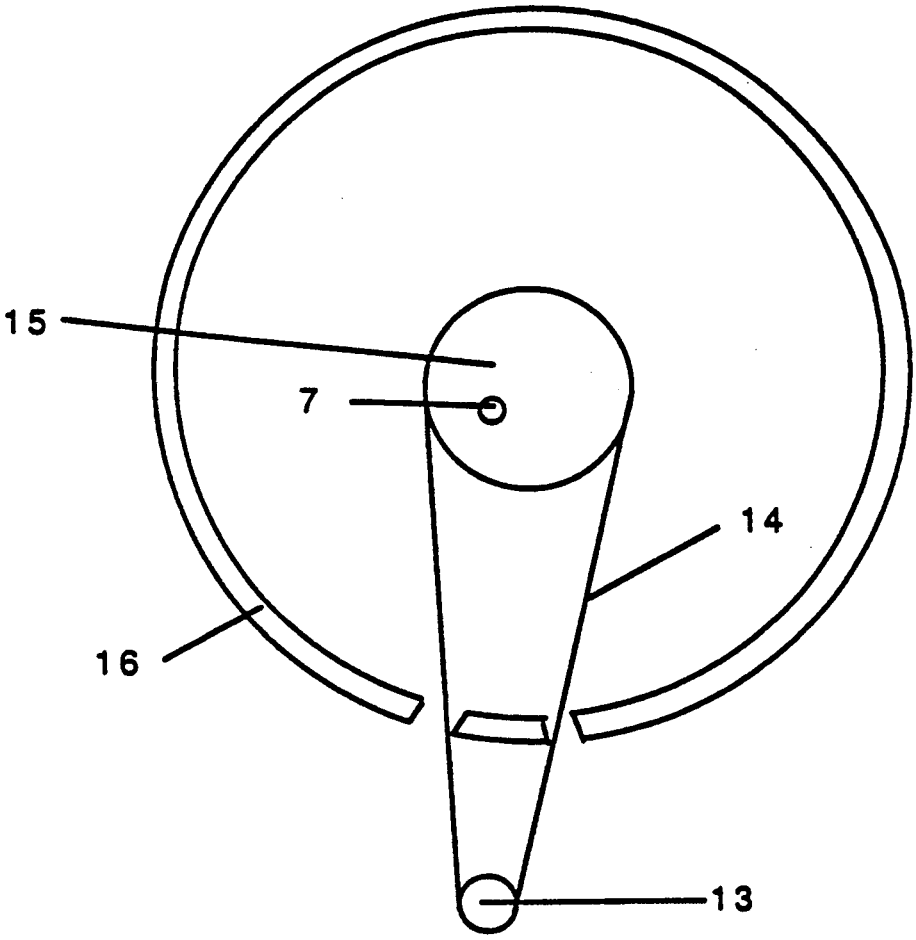
FIG. 5 is a cross-section through C-D of FIG. 4.

FIGS. 4 and 5 illustrate a second embodiment of the present invention. The construction of the housing 2 and the conduit 5 are essentially the same as in the previous embodiment discussed. In this embodiment however the conduit 5 is driven by a drive belt pulley system. A drive pulley 13*a* is situated outside the housing 2 and is connected by a drive belt 14 to a main pulley 15. A small motor 17 is connected to the drive pulley. The main pulley 15 is situated parallel to the front 16 of the housing 2 with the centre of the main pulley 15 being co-axial with the centre of the housing inlet 4. The main pulley 15 sits on a ball bearing race 19.

The conduit 5 passes accentrically through the main pulley 15 near its free end 7. Drive pulley 13*a*, which is driven by motor 17 causes the main pulley 15 to turn via drive belt 14. The accentrical position of the conduit 5 means that movement of the main pulley 15 causes the free end 7 of the conduit 7 to describe a circular motion. The speed of movement of the tube 5 can be altered by changing the output of the motor 17.

The above embodiment does not have fins for the air dispersal means, instead it has a perforated plate 18 situated near the drive pulley arrangement. The perforated plate 18 also provides a base for the ball bearing race 19.

In operation, the motor 17 causes the conduit 5 to rotate, flinging out droplets of fluid from its end 7. Air under pressure is caused to enter the housing inlet 3 after which it passes through the perforated plate 18 before mixing with the droplets created from the conduit and expelling them from the housing exit 4.

Although this embodiment and the other embodiments discussed do not show an electrostatic device, it should be appreciated that it is envisaged that these embodiments can be adapted to include same.

Figure 6:
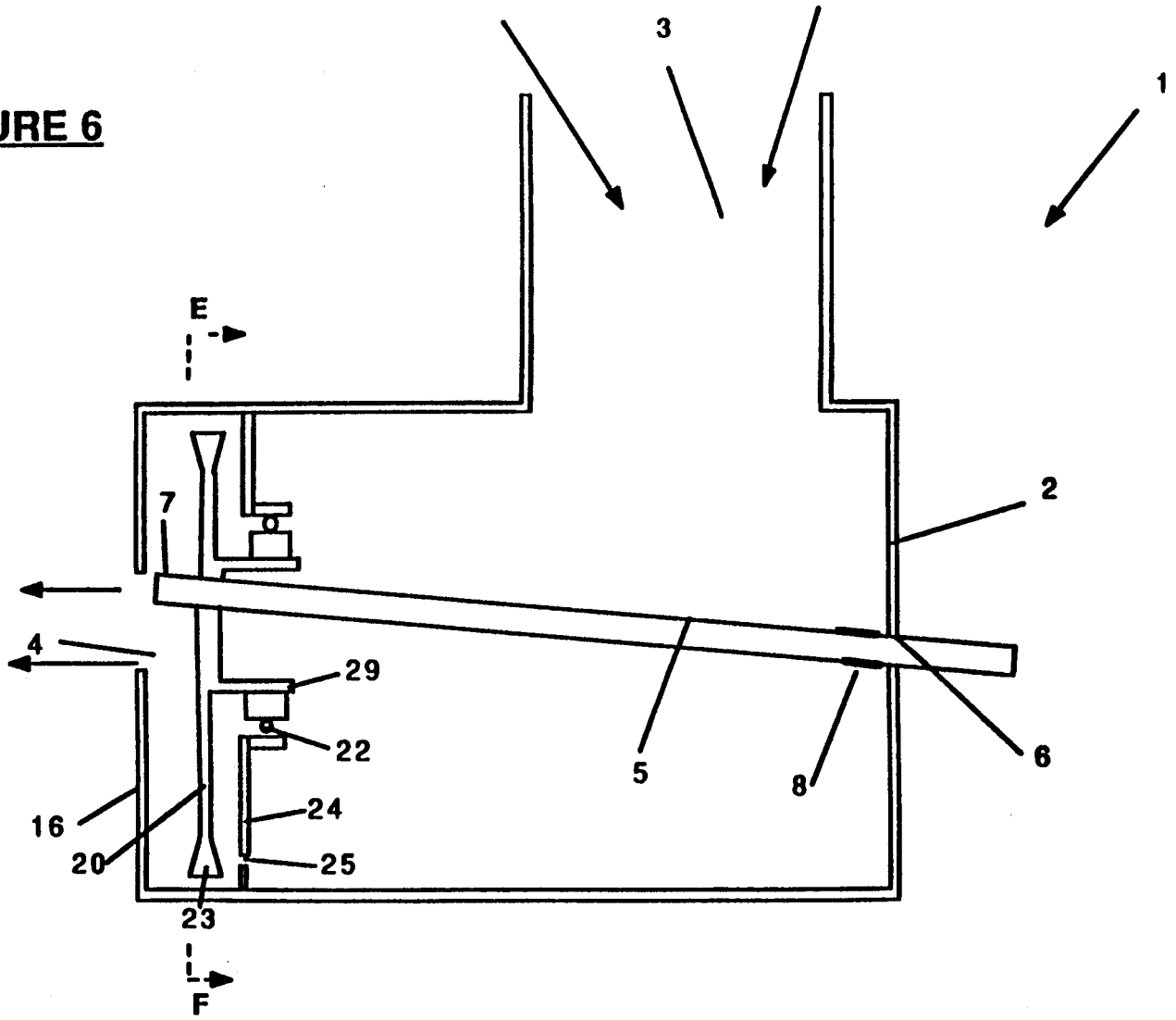
FIG. 6 is a diagrammatic cross-section of a third embodiment of the present invention, and FIG. 7 a cross-section through E-F of FIG. 6.
Figure 7:
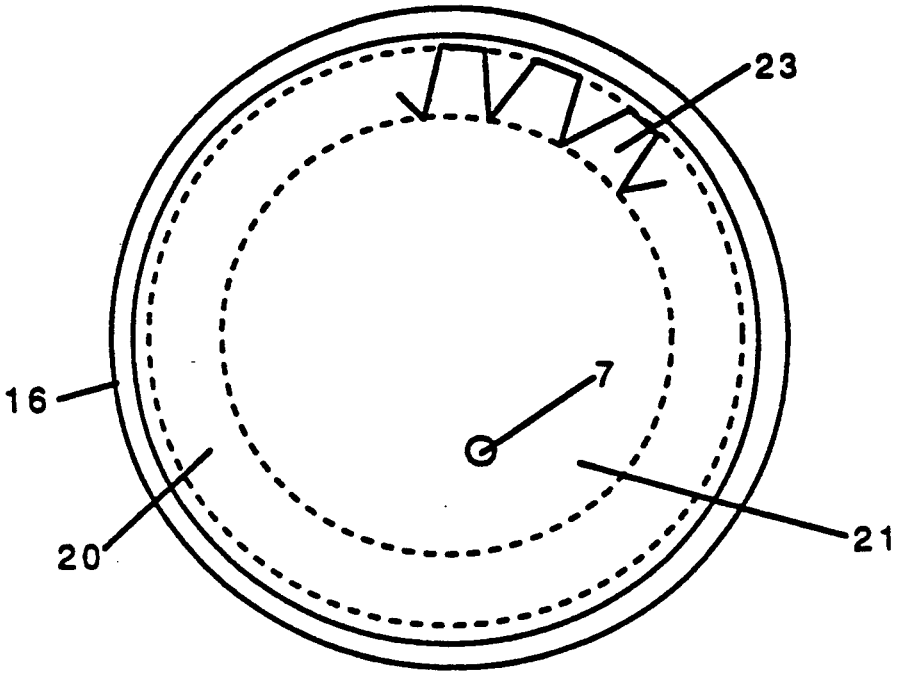

A third embodiment of the present invention is illustrated in FIGS. 6 and 7. In this embodiment the conduit 5 is accentrically fitted to a revolving disc 20. The disc 20 has a central column 21 which is supported by a ball bearing race 22 with the diameter of the disc 20 being slightly less than the internal diameter of the housing 2. Around the edge of the disc 20 are regularly spaced fins 23. A perforated plate 24 which acts to support the ball bearing race 22 is situated behind the disc 20.

In operation, air under pressure is supplied through the housing inlet 3. This air passes through the perforations 25 creating a force on the fins 23 of the disc 20. This force causes the disc 20 to rotate which in turn causes the free end 7 of the conduit 5 to circulate. The motion of airflow from the housing outlet 4 provides the desired shearing effect on the droplets flung from the conduit 5.

Figure 8:
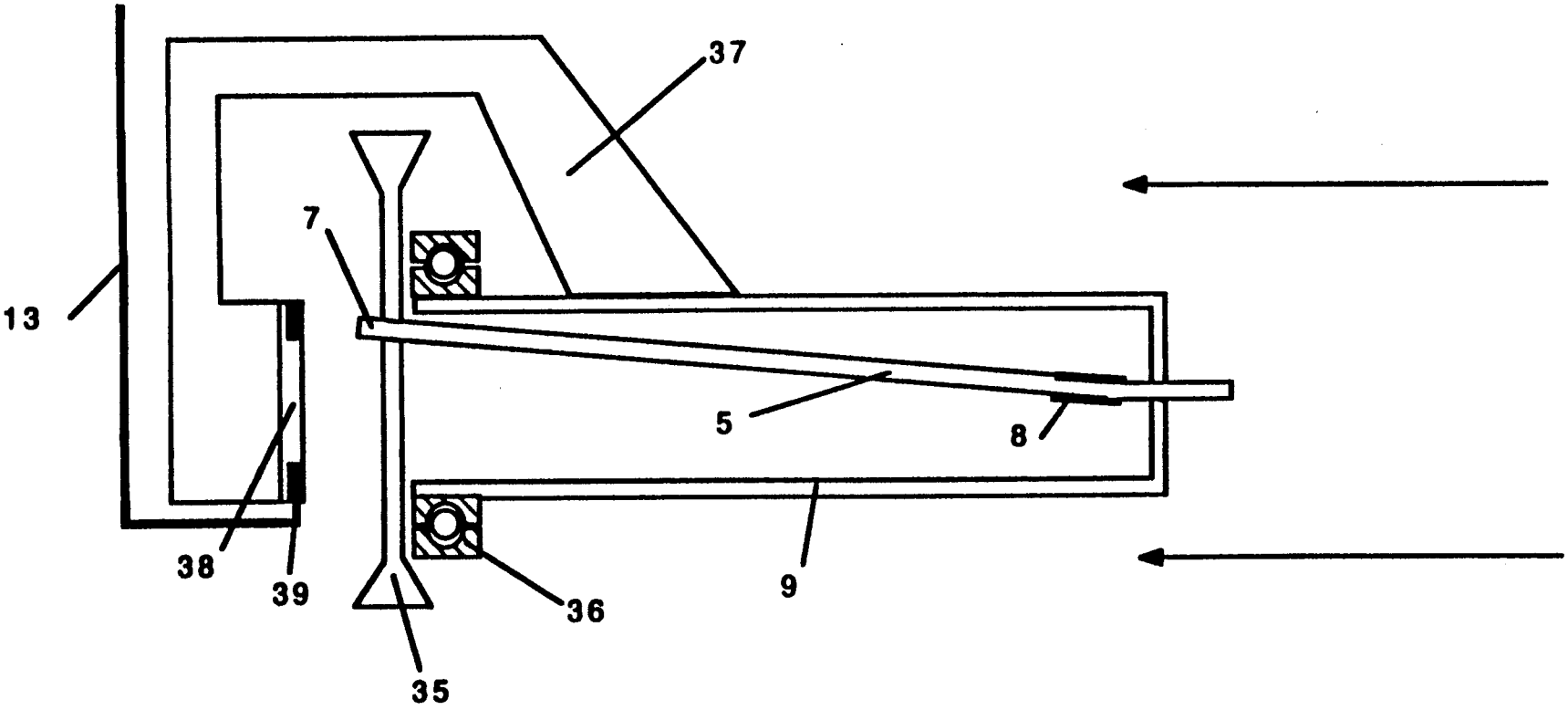
FIG. 8 is a diagrammatic cross section of a fifth embodiment of the present invention.
Figure 9:
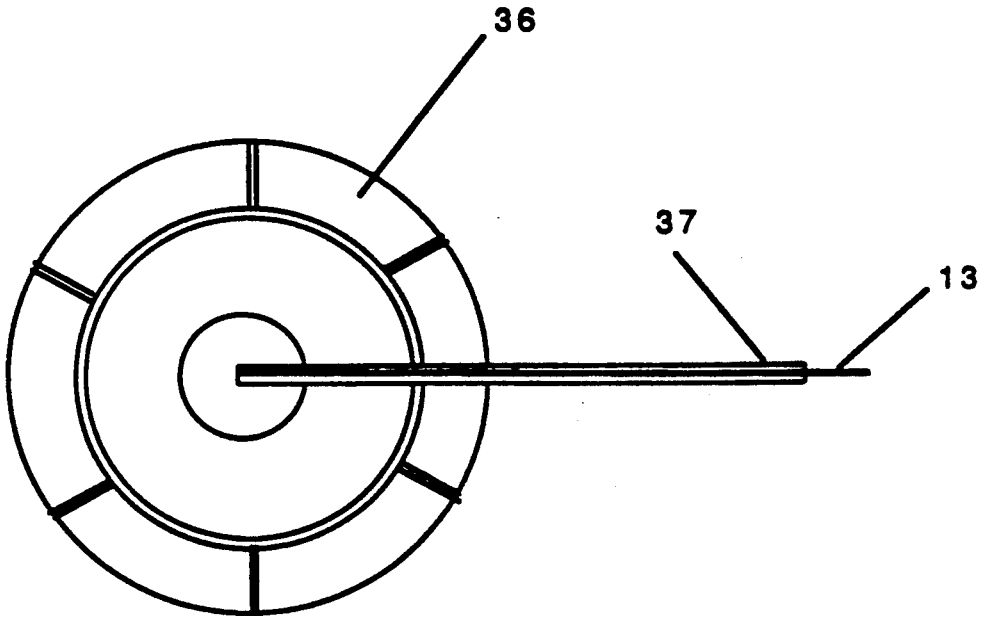
FIG. 9 is a diagrammatic cross section of the embodiment shown in FIG. 8.

A further embodiment of the present invention is illustrated in FIGS. 8 and 9. This embodiment differs from other embodiments in that there is no housing as such and the air flow associated with the nozzle assembly is provided the actual movement of the nozzle assembly itself. It is envisaged that this embodiment will be best operated connected to a motive device such as a tractor or an aircraft, especially as it is believed that this embodiment is the most suitable for horticultural spraying. Because of the imprecise nature of horticultural spraying and desire to attain maximum coverage, it is envisaged that a number of nozzle assemblies may be used within the one spraying apparatus.

The construction of the fluid conduit 5 in this embodiment is similar to that described before. The end 7 of the fluid conduit 5 is connected to a propeller disk 35 which rests on a ball race 36 attached to the wall 9 within which the fluid conduit 5 is situated. Extending from the wall 9 is an electrode-support pillar 37. This pillar extends above the propeller 35 and is angled so that an electrode-plate 38 on the end of the pillar 37 is positioned in front of the end 7 of the fluid conduit 5. Both the pillar 37 and electrode-support plate 38 are electrically insulated. Encircling the electrode-support plate is an electrode-ring 39.

In operation, the end 7 of the fluid conduit 5 is situated so that fluid will emerge from it in the same direction as air moving past the motive device to which the nozzle assembly is attached. If the motive device is proceeding at a fast enough speed, the air flow from the movement of the device will be sufficient to turn the propeller 35 and hence the end 7 of the conduit 5 so that droplets are flung from the conduit 5 to create a spray cloud. Movement of the propeller 35 also causes a shearing effect on the droplet cloud. The positioning of the electrode-ring 39 ensures that the droplet cloud is evenly charged.

If the motive device is too slow to provide the air flow necessary to achieve the desired effect, a further fan may be used to provide the additional air flow, perhaps such as that found in air blast sprayers.

It can be seen that the present invention can be adapted for use in many embodiments and can be used for a variety of applications. For instance, the present invention can be used for treatment of timber with sprays such as antisapstain, horticultural spraying, painting and so forth.

Aspects of the present invention have been described by way of example only and it should be appreciated that modifications and additions may be made thereto in accordance with the invention as defined in the accompanying claims.

I claim:

1. A nozzle assembly for a fluid distribution device including a fluid conduit with a first end and a second end, the fluid conduit having a flexible element enabling the first end of the fluid conduit to move with respect to the second end of the fluid conduit, the second end being connectable to a fluid supply, the nozzle assembly being characterized in that there is sufficient space around the first end of the fluid conduit to allow gas flow introduced into the nozzle assembly to emerge coincident with fluid emerging from the first end of the conduit, and the gas flow introduced into the nozzle assembly directly moves the first end of the fluid conduit sufficiently so that said centrifugal force from the movement of the conduit by the gas flow breaks up fluid from the fluid conduit as it emerges through the first end, and the gas flow past the first end of the fluid conduit is sufficient to cause a shearing effect on the fluid emerging from the first end of the conduit, and wherein means for creating an electrostatic charge of the fluid emerging from the first end of the fluid conduit is situated in the vicinity of the first end of the fluid conduit; the first end of the conduit being moveable fast enough to prevent arcing by the electrostatic means.

2. A nozzle assembly as claimed in claim 1 wherein the flexible element is the fluid conduit.

3. A nozzle assembly as claimed in claim 1 wherein the fluid conduit comprises a rigid tube and a flexible joint, wherein the flexible joint is the flexible element of the conduit.

4. A nozzle assembly as claimed in claim 1 wherein the nozzle assembly includes a housing and a housing outlet wherein the first end of the conduit is positioned in the vicinity of the housing outlet so that fluid emerging from the first end of the fluid conduit also emerges from said housing outlet.

5. A nozzle assembly as claimed in claim 4 including a housing inlet, the arrangement and construction of the housing being such that gas flow can be introduced into said housing inlet and emerge from the housing outlet.

6. A nozzle assembly as claimed in claim 1 wherein means for creating a electrostatic charge on the fluid emerging from the first end of the fluid conduit is situated in the vicinity of the first end of the fluid conduit.

7. A nozzle assembly as claimed in claim 6 wherein the means for creating a electrostatic charge on the fluid is in the form of an electrode ring.

8. A nozzle assembly as claimed in claim 1 wherein the nozzle assembly includes at least one air dispersal means situated in the vicinity of the first end of the fluid conduit.

9. A nozzle assembly as claimed in claim 8 wherein the air dispersal means is a fan.

10. A nozzle assembly as claimed in claim 8 wherein air introduced into the nozzle assembly drives the air dispersal means.

11. A nozzle assembly as claimed in claim 9 wherein the first end of the fluid conduit is attached to the air dispersal means.

12. A method of fluid dispersal using a nozzle assembly comprising the steps of:

providing a fluid conduit in said nozzle assembly having a first end and a second end, wherein said second end is connected to a fluid supply;

moving fluid from said fluid supply through said fluid conduit toward said first end;

introducing gas into the assembly and flowing it out of the assembly around the first end of the conduit to emerge coincident with the fluid emerging from the conduit, the gas flow into the assembly directly moving the first end of the conduit sufficiently to create centrifugal force within said conduit to break up fluid as it emerges from the conduit at first end;

flowing the gas past said conduit first end as the fluid emerges therefrom with sufficient flow cause a shearing effect on the fluid emerging from the first end of the conduit; and applying an electrostatic charge on the fluid emerging from the first end of the fluid conduit by means situated in the vicinity of the first end of the fluid conduit;

the movement of the first end of the conduit produced by the gas flowing out of the first end of the conduit being fast enough to prevent arcing by the electrostatic means.

* * * * *

UNITED STATES PATENT AND TRADEMARK OFFICE

CERTIFICATE OF CORRECTION

PATENT NO. : 5,188,291

DATED : February 23, 1993

INVENTOR(S) : David John Cross

It is certified that error appears in the above-identified patent and that said Letters Patent is hereby corrected as shown below:

On the title page of the patent, Column 1, after the line "[22] Filed: May 29, 1990" please add the following:

[30] Foreign Appliction Priority Data
May 31, 1989 [NZ] New Zealand 229355

Column 8, line 52, change "sufficient flow" to --sufficient flow to--.

Signed and Sealed this

Eighth Day of March, 1994

Bruce Lehman

*Attest:*

BRUCE LEHMAN

*Attesting Officer*

*Commissioner of Patents and Trademarks*